United States Patent [19]

Johannes

[11] 4,293,351

[45] Oct. 6, 1981

[54] SILICONE RUBBER EXPLOSIVE AND METHOD OF MAKING

[76] Inventor: Gerald E. Johannes, 565 Frank Ave., SE., Huron, S. Dak. 57350

[21] Appl. No.: 63,689

[22] Filed: Aug. 6, 1979

[51] Int. Cl.[3] ..... C06B 45/10

[52] U.S. Cl. ..... 149/19.2; 149/92; 149/93; 149/109.6

[58] Field of Search ..... 149/19.2, 92, 93, 109.6

[56] References Cited

U.S. PATENT DOCUMENTS

| | | | |
|---|---|---|---|
| 4,047,990 | 9/1977 | Falterman et al. | 149/19.2 |
| 4,088,518 | 5/1978 | Kehren et al. | 149/19.2 |

*Primary Examiner*—Stephen J. Lechert, Jr.

*Attorney, Agent, or Firm*—LeBlanc, Nolan, Shur & Nies

[57] ABSTRACT

Explosive materials in granular or other finely divided form are distributed in pourable silicone rubber with acetic acid added as a catalyst.

2 Claims, No Drawings

SILICONE RUBBER EXPLOSIVE AND METHOD OF MAKING

This invention relates to elastomeric explosive compounds and methods of making them and particularly to such wherein a particulate explosive composition such as PETN (pentaerythritol tetranitrate) or RDX (cyclotrimethylenetrinitramine) is distributed in pourable silicone rubber.

Flexible and deformable explosives utilizing PETN and RDX have been proposed and used. Examplary are those disclosed in U.S. Patents to Fassnacht et al U.S. Pat. No. 2,992,887; Breza et al U.S. Pat. No. 2,999,743; Forrest et al U.S. Pat. No. 3,311,513 and Evans U.S. Pat. No. 3,407,731.

The present invention has for its major object the provision of a novel flexible composition wherein PETN and/or RDX are distributed in pourable silicone rubber to form a flexible product that is initially in rather sticky condition, and becomes more dimensionally stable as it may be aged or heat treated while retaining good elastomeric properties. A catalyst in the form of about 1–10% by weight acetic acid is added to accelerate and facilitate mixing and improve the final product.

Further to this object minor amounts of the PETN or RDX may be replaced by other well known explosive materials such as TNT, ammonium perchlorate and the like for special explosive effects. However in all forms the product contains essentially PETN or RDX as the explosive material phase.

Further to the foregoing objects the invention contemplates the use of essentially any known commercial silicone rubber that is or may be heated to be pourable, and the ratio of silicone rubber to the explosive material should be in the range of 20–50 parts by weight of silicone rubber to 80 to 50 parts by weight of the explosive material content, as will appear in selected examples.

Further objects will appear as the description proceeds in association with the appended claims.

EXAMPLE I

40 Grams viscous but pourable silicon rubber (Dow Corning Silastic Jr t v) was mixed with 60 grams of superfine PETN (pentaerythritol tetranitrate) in a wooden vessel having wooden agitating paddles, until a smooth paste was formed. The mixture was accelerated by a catalyst which was acetic acid, glacial acetic acid, but could but could be even a weaker acetic acid like vinegar. For example up to 5% by weight of glacial acetic acid was used in satisfactory examples.

This paste was very tacky and will adhere to almost any surface. It becomes more viscous as it ages. It has a unique characteristic in that it will detonate in very small diameter holes or tubes when more fluid, and is equally detonatable in thin surface coating layers and also more solid. It may be detonated by a standard blasting cap.

This material is otherwise resistant to detonation at temperatures up to 400° F.

EXAMPLE II

80% PETN was mixed with 20% silicon rubber to form paste as in Example I. Up to 5% of the acetic acid catalyst (Silastic gli 28042) was incorporated to make the product more flexible while it is curing. This compound exhibited high tensile strength, and detonated at about 27000 ft/sec. Five percent by weight of weak acetic acid was used as a catalyst.

EXAMPLE III

Equal parts by weight of superfine RDX (cyclotrimethylenetrinitramine) and silicone rubber were admixed to form a tacky paste. A small amount of weak acetic acid, about 5% was used as a catalyst as in the earlier examples. This material was detonated by a standard blasting cap, but it was resistant to high impact such as a rifle bullet.

EXAMPLE IV

70% superfine (400 micron) RDX was admixed with 30% silicone rubber at a temperature of about 150% F. The available range is about 150% F. to 200° F. A small amount of glacial acetic acid was used as a catalyst. The material was cooled to extrudable form. Portions were cast or extruded to shape.

EXAMPLE V

80% superfine PETN was mixed in a wooden vessel with 20% silicone rubber in the presence of a small amount of an acetic acid type catalyst. This compound was very gummy and tacky and may be applied to surfaces in thin layers as thin as 3/16 inch and detonated there with a standard blasting cap. It is waterproof at very high or low temperatures, and has good shelf life.

In each of the above examples the product of the silicone rubber-explosive material mixture was a viscuous relatively tacky or sticky paste, relatively safe to handle. The paste can be directly adhered in any desired distribution to a surface at the explosion site. It may be forced into small bore holes for selective action. It have discovered it highly advantageous to include up to from about 1–5% glacial acetic acid or equivalent amount of weaker acetic acid to catalyze and speed up the mixture, and such also appears to increase the elastomeric characteristics of the final product. Where weaker acetic acids are used the amount of catalyst may be in the range of about 1–10% by weight of the explosive rubber content.

If allowed to age it becomes less tacky but retains its flexibility. It may be converted to extrudable form by heating and cooling, and the extruded products are fairly dimensionably stable while being readily flexed or deformed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. The method of making an explosive product wherein a particulate explosive material containing mainly a composition selected from the group consisting of PETN and RDX is mixed with a pourable silicone rubber in the ratio of 20–50 parts by weight of silicone rubber to 80–50 parts by weight of explosive material and about 1–5% by weight of glacial acetic acid or an equivalent amount of weaker acetic acid as a catalyst, to form a tacky viscous paste wherein the explosive material is uniformly distributed.

2. The method defined in claim 1, wherein the paste is heated in the range of 150°–200° F., cooled to ambient temperature and extruded in selected shapes.

* * * * *